US005912423A

United States Patent [19]

Doughty et al.

[11] Patent Number: 5,912,423

[45] Date of Patent: Jun. 15, 1999

[54] METHOD AND MEANS FOR PURIFYING AIR WITH A REGENERABLE CARBON CLOTH SORBENT

[75] Inventors: David T. Doughty, Moon Township; Michael Greenbank, Monaca, both of Pa.; Daniel D. Thayer, Auburn, Me.

[73] Assignee: Calgon Carbon Corporation, Pittsburg, Pa.

[21] Appl. No.: 08/787,867

[22] Filed: Jan. 23, 1997

[51] Int. Cl.[6] ..... B01D 53/06

[52] U.S. Cl. ..... 95/107; 55/290; 55/354; 95/148; 96/143; 96/150

[58] Field of Search ..... 95/107, 148, 278; 96/143, 150, 154; 55/290, 354, 351

[56] References Cited

U.S. PATENT DOCUMENTS

| | | | |
|---|---|---|---|
| 3,062,732 | 11/1962 | Keidel | 55/354 |
| 3,375,638 | 4/1968 | Dungler | 55/290 |
| 4,405,342 | 9/1983 | Bergman | 55/354 |
| 5,628,819 | 5/1997 | Mestemaker et al. | 96/143 |

FOREIGN PATENT DOCUMENTS

| | | | |
|---|---|---|---|
| 4104513 | 2/1991 | Germany . | |
| 51-135896 | 11/1976 | Japan . | |
| 63-214317 | 9/1988 | Japan | 55/354 |
| 2-46848 | 2/1990 | Japan . | |
| 2-46852 | 2/1990 | Japan . | |
| 5-277328 | 10/1993 | Japan | 96/150 |
| 5-277331 | 10/1993 | Japan | 96/150 |
| WO 94/03270 | 2/1994 | WIPO . | |

*Primary Examiner*—Duane S. Smith
*Attorney, Agent, or Firm*—Titus & McConomy LLP

[57] ABSTRACT

A method and apparatus for removing contaminates from an air stream in which an adsorbent activated carbon cloth is positioned in said air stream. The method and apparatus provide for impressing an electric current through the cloth adsorbent to desorb any contaminates adsorbed thereon.

15 Claims, 2 Drawing Sheets

METHOD AND MEANS FOR PURIFYING AIR WITH A REGENERABLE CARBON CLOTH SORBENT

FIELD OF THE INVENTION

The present invention relates to a method for the removal of undesirable contaminants from an air stream by use of an activated carbon cloth medium and, in particular, to cloth adsorbent that can be regenerated by direct application of an electric current. The invention is particularly well adapted to increase the purity of air within enclosed spaces, such as rooms, buildings or vehicles.

BACKGROUND OF THE INVENTION

In recent years, there has been an increasing concern with the quality of the air, especially with health-related aspects such as "Sick Building Syndrome", and the concern for odors within buildings and other structures. These concerns have become more acute with the advent of energy-related trends for reduction of air exchange rates within buildings which increase stale, odorous air, and potentially harmful components in building air. This, in turn, has led to an increased interest in systems and devices to reduce the amount of these undesirable contaminants in breathing air.

The undesirable materials sought to be removed from air are generally found in two fundamental forms: particulate and gas or vapor. For particulate removal, a number of processes are available and currently practiced, including barrier filtration, electrostatic precipitation, etc.

For the gas and vapor components, which are frequently organic compounds, technologies involving activated carbon adsorption are typically recommended. Physical adsorption on activated carbon is the most efficient means of removing a mixture of a wide variety of contaminants from air at levels in the part per million by volume (ppmv) or lower concentrations. There are several means of applying activated carbon, each with its associated advantages and disadvantages.

Frequently, granular activated carbon (GAC) or pelletized activated carbon is placed in trays, either loose, or held in place by a retention screen, and placed within the air stream of a building HVAC system. Alternately, the carbon can be placed within an air-handling device sized to treat the air in a single room. The particle size of the carbon is relatively large, several millimeters in diameter, to increase the size of the void spaces between the particles and thus reduce the pressure drop at a given linear velocity of air. However, the large particle size also increases the length of the diffusion path a contaminant molecule must travel, and therefore the time to adsorb. Consequently, the residence time of the contaminated air in contact with the GAC must be increased proportionately. Problems with such systems include high pressure drops, and the need for periodic replacement of the carbon as its capacity is spent. Such replacement can be laborous and potentially dangerous if harmful or hazardous materials are removed by the systems.

An alternative to GAC is powdered activated carbon (PAC). PAC has a 50 to 100 times smaller particle size, and thus shorter diffusion paths for adsorption. As a result, the residence time the gas must be in contact with the carbon bed is reduced proportionately. This allows for very thin bed depths of millimeter thicknesses. However, PAC is very difficult to contain, and the pressure drop across the bed can be extremely high.

Some of these handling issues have been addressed by enclosing the otherwise loose carbon (GAC or PAC) within a matrix of some sort. Thus, the carbon can be bonded to itself or to a support structure to form a self-supporting block, panel or slab (WO 94/03270, PCT/US93/06274). It can also be adhered to fibers in a woven or nonwoven web structure. The carbon can then be handled as a number of carbon media units, rather than as a loose material. Pressure drops by the media are addressed by providing void spaces within the matrix. The spacing of the carbon particles decreases the pressure drops to acceptable levels, but the efficiency of the media filter is reduced because a substantial portion of the air passes through the filter without contacting a carbon particle. This solution, however, does not address the issue of a finite adsorption capacity of the carbon for the contaminants. Consequently, the need for replacement remains. In fact, the process of binding the carbon frequently causes a reduction in capacity, as some of the carbon surface is occluded by the adhesive.

Methods are also known whereby the capacity of activated carbon, or an activated carbon media can be substantially regenerated. This reduces the frequency with which maintenance is required. Alternatively, regeneration permits the use of smaller quantities of carbon which reduces capital cost and space requirements without an associated reduction in effectiveness. The process of regeneration is frequently accomplished by heating the carbon bed by some means. It is known in the art that the capacity of an activated carbon for materials removed by the mechanism of physical adsorption is decreased at elevated temperature. Thus, when the temperature of a quantity of activated carbon which has largely been loaded to its saturation with a given contaminant is increased, the contaminant will desorb from the pore structure of the carbon, and can be swept away with a suitable purge stream. Thus, when the carbon is cooled, a significant portion of the original capacity is restored. The actual temperature of the internal carbon structure at any point in time dictates the adsorption capacity of the contaminants and thus the amount of desorption, and the capacity recovered for the next adsorption cycle. Commonly, the heat necessary to warm the carbon is supplied externally. Thus the temperature of the external heat source must always be greater than or equal to the activated carbon structure. The carbon bed is commonly heated by application of hot air, such as by heating a sweep gas, or with steam. It can also be heated by placing heating elements in contact with the carbon particles or carbon media JP 51 135896.

It is known in the art that activated carbon, because of its localized graphite-like structure, is capable of conducting electricity. It is also known that the resistance properties are such that useful heat can be generated in this manner. Thus, some attempts have been reported to utilize this property to generate the heat necessary to achieve regeneration of activated carbon beds (DE 4104513). Unfortunately, this method has generally been attempted with beds of granular or pelleted carbon, or media derived therefrom and they have met with only limited success. Typically encountered problems include non-uniform heating patterns, hot-spots, and short-circuits.

In addition to the well-known traditional physical forms of activated carbon (i.e., granular, pelletized, spherical, powdered), it is also known that activated carbon can be prepared in the form of activated carbon cloth (ACC) or activated carbon felt (ACF). This adsorption media consists of activated carbon in the form of woven or knitted (ACC), or loose mat (ACF) activated carbon fibers. The fibers have a diameter similar to PAC, and therefore provide diffusion paths and adsorption rates similar to PAC. The advantage of ACF and ACC is that they are easy to apply in very thin beds of millimeter dimensions, like the PAC bonded to supports, with adequately low pressure drops, but with efficiencies as high as the deeper GAC beds. Because the fibers of the ACC can be of very small diameter, and because the pressure drop across a number of layers of cloth can be small, the ACC has dynamic properties which are well suited to the problem of air purification. The ACC and ACF forms, however, suffer from the same limitations as to their adsorption capacity of the other forms of activated carbon. Thus, the time between replacements can be unacceptably short. Some have attempted to regenerate ACC and ACF media by heating with air, or by placing the media in contact with an electrical heater (JP 2046852, JP 2046848).

Accordingly, it is an object of the present invention to provide a means and method for enhancing the purity of air stream without the attendant disadvantages inherent in the prior art methods. It is a further object of the invention to provide a method to remove contaminates in air streams using a woven and knitted ACC that can be regenerated very effectively and uniformly by directly heating with an electrical current. It is also an object of the invention to provide a method and apparatus for continuously adsorbing organic materials and other contaminates from an air stream and subsequently regenerating the capacity of the ACC.

SUMMARY OF THE INVENTION

The present invention provides an improved method for removing objectionable contaminant vapors or gases from an air stream. In general, the present invention provides a method of contacting an air stream having materials to be adsorbed with a activated carbon cloth movably positioned across the stream to provide a substantially continuous adsorption and desorbing the adsorbed materials by electrically heating the cloth. The contaminants to be removed include any of a number of odorous or potentially harmful gases, such as toluene, xylene, propane, butane, benzene, hexane, hydrocarbons, mercaptans, aldehydes, ketones, amines, sulfides, and the like. The method is particularly useful for removing said contaminants from air streams within various building structures, such as commercial, residential, or industrial buildings because of its high efficiency and compact space requirements. It is also applicable and useful for treating air streams in vehicles.

One embodiment of the present invention also provides a means for removing the contaminants from air by contacting the contaminated air stream with an activated carbon cloth (ACC) comprised of activated carbon fibers. The fibers may be woven or knitted or otherwise assembled in any of a number of ways to provide the cloth. Generally the cloth is moved across the air stream at a rate determined by the airflow, contaminate level and capacity of the ACC. The ACC removes contaminants by means of physical adsorption on the activated carbon fibers. When the cloth is loaded with the contaminants to a suitable portion of its capacity, the ACC is regenerated by removing the adsorbed contaminants by passing an electrical current therethrough. The cloth is returned essentially to its initial, unloaded state. The electric current causes the temperature of the fibers to rise causing desorption of the adsorbed contaminant. Thus, the carbon fibers function as both an adsorbent surface and heat source. Because no heat transfer from a second heating body is required, the method is inherently more thermally efficient than prior art methods. It is also more efficient because the heat for desorption is generated within the sorbent media itself, where the thermodynamics of the adsorption and desorption processes are dictated. During the period when current is being passed through the carbon cloth, the method of the present invention provides that a suitable purge stream of air or inert gas be used to convey the desorbed contaminants away from the cloth to an appropriate location for venting or other disposal means. Other advantages of the invention will become apparent from perusal of the following description of presently preferred embodiments taken in connection with the accompanying drawings.

PRESENTLY PREFERRED EMBODIMENTS

Figure 1:
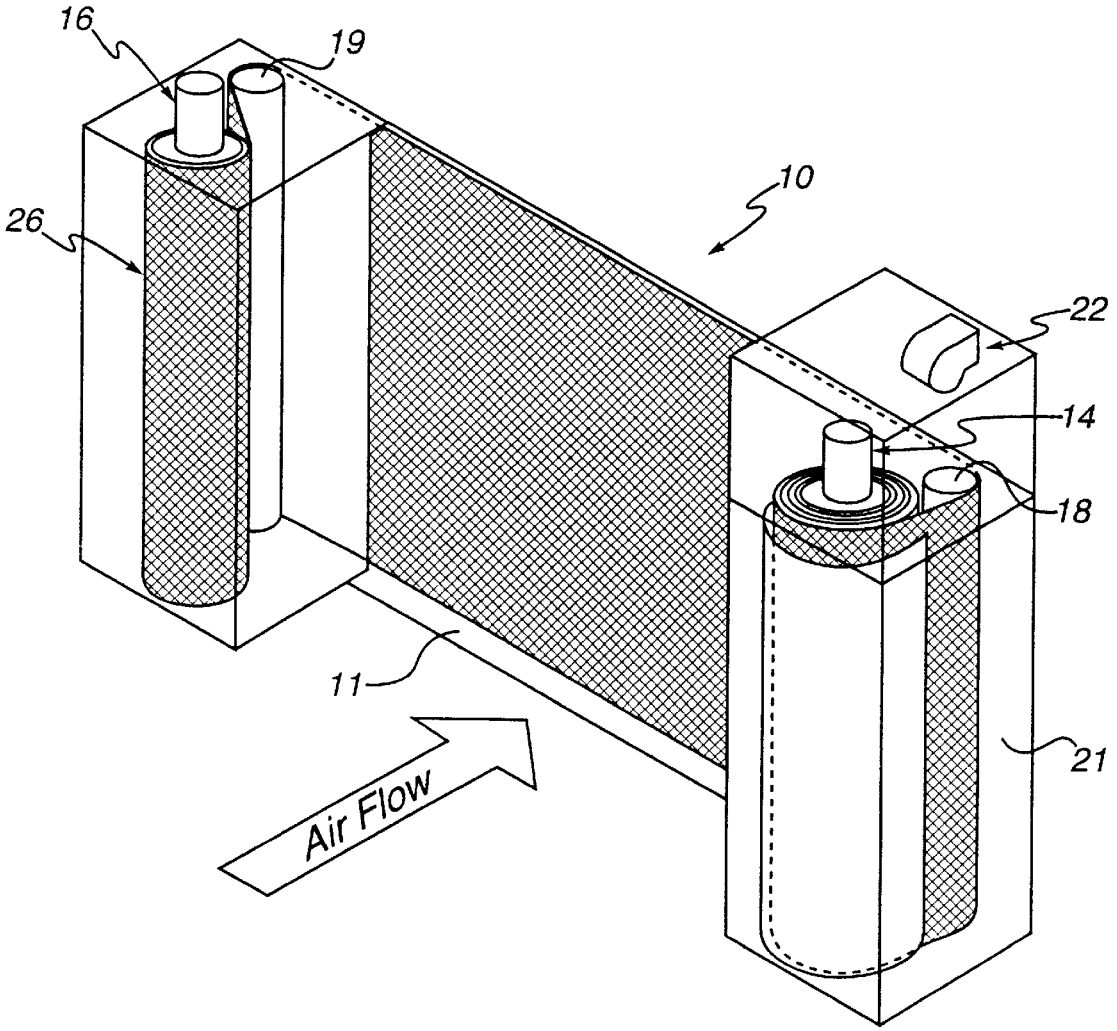
FIG. 1 is a diagrammatic representation of a presently preferred means for practicing the methods of the present invention.

With reference to FIG. 1, a presently preferred embodiment of the invention is shown in which adsorber 10 includes an activated carbon cloth 11 positioned across an orifice in an air stream containing contaminates to be removed. In the preferred embodiment cloth 11 is wound around rolls 14 and 16. In this embodiment electrodes 14 and 18 are positioned adjacent one of opposing rolls 14 and 16, respectively.

Motors, not shown, or other means are operably connected to rolls 14 and 16 to movably position cloth 11 across the air flow by winding it on one or the other rollers. In this way, the air stream can be exposed to fresh sections of cloth as desired either in a continuous or discontinuous mode. In the continuous mode the cloth is continuous moved across the air stream at a rate selected in accordance with the flow and loadings on the cloth. In the discontinuous mode the cloth is positioned across the air stream and remains positioned there until it approaches sutmation at which time an unabsorbed section of the cloth is in position to adsorb contaminates.

As cloth 11 is collected onto a take-up roll (in this case 14) in regeneration chamber 21, the width of the cloth is passed over roles 14 and 18 which are rendered electrically conductive and serve as a first pair electrode. When the cloth is judged to no longer have adequate capacity for removal of the contaminants of interest, it is regenerated by desorbing the contaminants therefrom. According to the method of the present invention, desorption is accomplished by reversing the path of the cloth and applying a suitable electrical current to the cloth as it passes between two electrodes. As the temperature in the cloth increase as a result of the electrical resistance, contaminants are desorbed. The desorbed contaminates are swept from the regeneration chamber by a small stream of air which is vented through vent 22 which can be to the atmosphere or disposal resource.

Additionally, it should be understood by those skilled in the art, that rolls 16 and 19 my also act as electrodes so that chamber 26 acts as a regeneration chamber thereby permitting continuous adsorption and regeneration. In either embodiment it is important that the cloth makes adequate contact with the electrodes to provide electrical contact.

Figure 2:
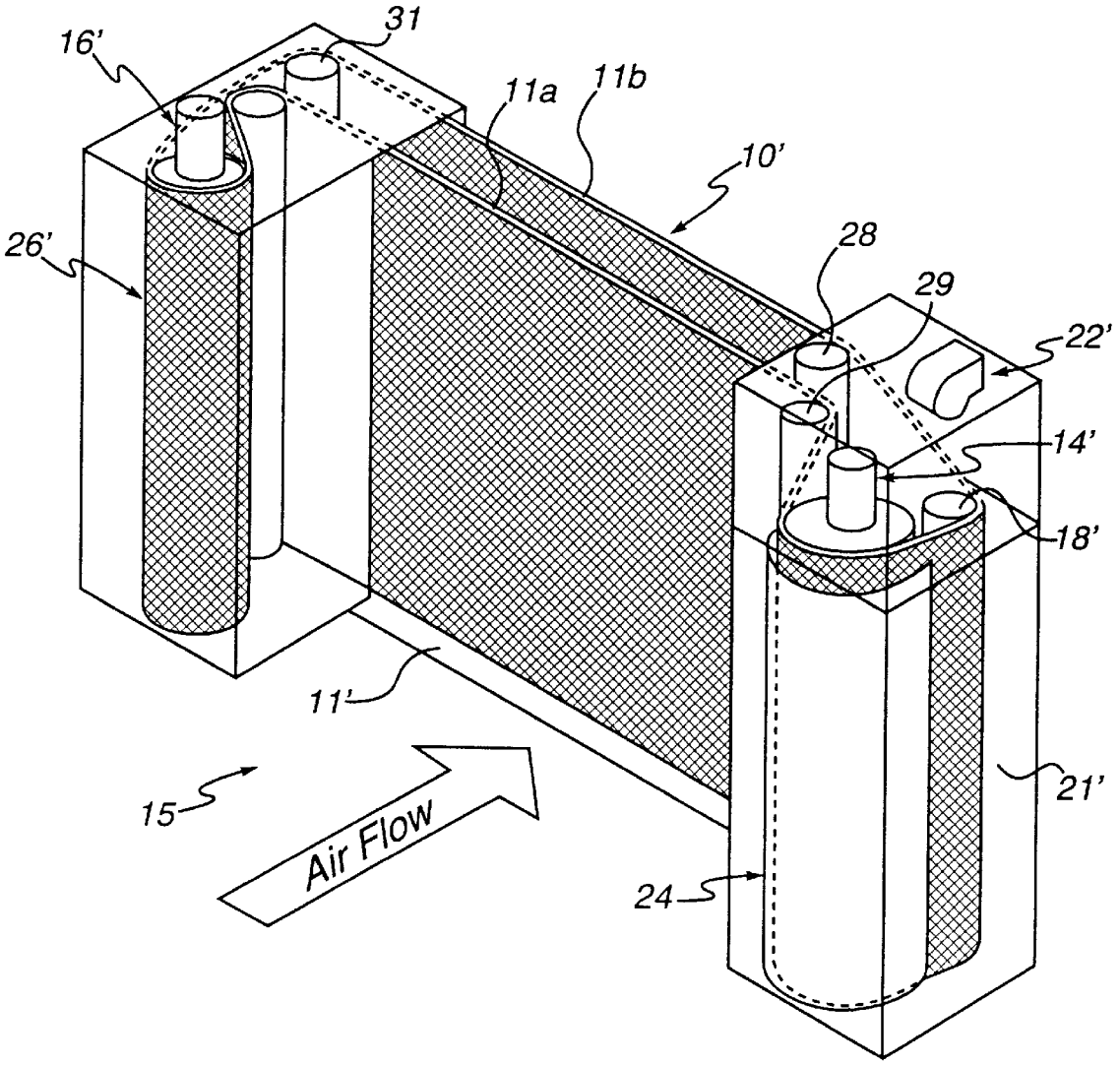
FIG. 2 is a diagrammatic representation of a presently preferred embodiment of the invention wherein the cloth adsorber is shown in a continuous loop.

With reference to FIG. 2, adsorber 10', roll 16' and vent 22' are equivalent to adsorber 10, roll 16 and vent 22 referenced in connection to FIG. 1. Another embodiment of the method of the present invention involves a continuous belt 11' of cloth passing over the air duct opening 15, as illustrated in FIG. 2. In this embodiment, the contaminated air stream contacts the belt 11' of carbon cloth twice. Either the first or leading cloth section 11*a* or the second or trailing cloth layer 11*b* has been freshly regenerated, and is thus better able to remove contaminants remaining after passing through the first cloth layer. Where the leading cloth layer is not adsorbed, it can function to reduce higher concentrations of contaminants prior to entering the regeneration zone. Regeneration by means of electric current is accomplished as before above, that is by passing the cloth over two conductive surfaces e.g. rollers 14' and 18' or potential grid 24 to which an electrical potential is applied. If desired, a regeneration apparatus can be placed on both sides of the duct so that the cloth belt is regenerated prior to both passes through the air duct. In this embodiment additional rollers 28 and 29 in regeneration chamber 21' are shown and additional roller 31 is positioned in chamber 26'. The additional rollers are used to guide the cloth but can also act as additional electrodes to preheat the cloth prior to regeneration.

The method of the present invention has been found to be useful for removing various impurities from air streams, and for returning the adsorbent material to near its native condition. The present invention is further illustrated in the following examples, from which other advantages will be apparent.

EXAMPLE 1

Three layer of activated carbon cloth type FMI-250 (Charcoal Cloth International, Ltd.) was clamped in place across rectangular opening measuring 3.9×3.9 cm in a plastic sample holder. Layers of copper foil were placed on two opposite sides of the fixture, between the cloth layers, but not within the open are of the fixture. The strips were extended beyond the edge of the fixture so as to allow wires to be attached to the strips.

Cycle 1: (Adsorption) An air stream containing 80 ppmv n-butane and 50% relative humidity was then passed through the cloth at a linear velocity of 10 cm/sec. The concentration of butane in the effluent desorption steam was monitored. The temperature of the effluent air at a point approximately 1 cm above the cloth was 68° C. during the desorption period. The desorption was continued until the measured butane concentration was <10 ppmv. At this time, the electric current was turned off, and the cloth was allowed to cool in the purge stream. 18.1 mg of butane was removed from the cloth sample.

Cycle 2: (Adsorption) The cloth sample was again exposed to the air stream containing 80 ppmv butane, as in cycle 1, until the effluent reached 63 ppmv. 19.5 mg butane was removed from the air stream.

(Desorption) The electric current and dry air purge of cycle 1 (desorption) were reestablished as above, and maintained until the butane concentration in the desorption effluent was <10 ppmv. The cloth was allowed to cool under purge. 19.5 mg butane was desorbed.

Cycle 3: The adsorption and desorption steps of cycle 2 were repeated, except that adsorption loading was continued to an effluent concentration of 75 ppm. 22.2 mg of butane was removed in the adsorption step, and 22.2 mg butane was desorbed in the desorption step.

EXAMPLE 2

The apparatus and procedures of Example 1 were repeated, except that toluene at 80 ppmv was used as the contaminant in place of butane. Adsorption was carried out until the effluent reached 14 ppmv. Desorption was carried out using a current of 10 V, 2 A until the desorption effluent reached 10 ppmv. The quantities of toluene adsorbed and desorbed are listed in Table 1.

TABLE 1

| Cycle No. | Toluene Adsorbed (mg) | Toluene Desorbed (mg) |
|---|---|---|
| 1 | 255 | 153 |
| 2 | 168 | 145 |
| 3 | 171 | 154 |

While presently preferred embodiments of the invention have been shown and described in particularity, it may be otherwise within the scope of the appended claims.

What is claimed is:

1. A method for removing unwanted contaminants from an air stream comprising the steps of contacting said contaminated air with an adsorbent medium comprising an activated carbon cloth to adsorb contaminants from said air and thereafter passing an electric current through said activated carbon cloth, said electric current being sufficient to cause the temperature of the cloth to increase above that of said air and cause desorption of the unwanted component and directing said desorbed contaminates to a secondary stream apart from said air.

2. A method as set forth in claim 1 including the step of discontinuously or continuously moving said cloth into contact with said air to provide at least areas of contact with said air for adsorbing contaminants.

3. A method as set forth in claim 1 or 2 including the step of providing cloth that has undergone desorption being contacted by said air.

4. A method as set forth in claim 2 including the step of moving said contacted cloth out of said air stream as a portion of said cloth reaches a substantial portion of adsorption capacity, and applying said electrical current to said portion moved out of said streams.

5. Apparatus for the removal of contaminant from a stream of air comprising:

a. a housing having an air passageway for conduction of said air stream; and b. an activated carbon cloth positioned across said passageway, said cloth having at least first and second ends;

c. at least a first and a second electrode in contact with said first and second end, respectively; and d. means for applying an electrical current between said electrodes.

6. Apparatus as set forth in claim 5 wherein said activated carbon cloth is of a length greater than said passageway and including:

e. first and second cloth positioning means said positioning means being located across said passageway with respect to each other and said first and second ends of said cloth being attached to respective positioning means.

7. Apparatus as set forth in claim 6 wherein said positioning means comprise a first roller and a second roller.

8. Apparatus as set forth in claim 7 wherein said first and second rollers comprise said first and second electrodes.

9. Apparatus as set forth in claim 7 including a third roller and a fourth roller, said third roller being positioned adjacent said first roller and said fourth roller being positioned adjacent said second roller.

10. Apparatus as set forth in claim 9 wherein one of said first adjacent additional roller or said second and adjacent additional roller comprise said first and second electrode.

11. Apparatus as set forth in claim 9 wherein each said first and adjacent additional roller and said second and adjacent additional roller comprises a first and second electrode.

12. Apparatus as set forth in claim 9 or 10 including a desorption chamber for mounting said first and second electrode for capturing desorbed contaminates and disposal means for removing said captured desorbent therefrom.

13. Apparatus as set forth in claims 7, 8, 9 or 10 wherein said first and second rollers include controllable means for rotating said associated roller.

14. Apparatus as set forth in claims 5, 6, 7, 8, 9 or 10 wherein said first and second electrodes are controllably connected to a source of electrical power.

15. Apparatus as set forth in claim 13 including a desorption chamber.

* * * * *

UNITED STATES PATENT AND TRADEMARK OFFICE

CERTIFICATE OF CORRECTION

PATENT NO. : 5,912,423

DATED : 06/15/1999

INVENTOR(S) : David T. Doughty, Michael Greenbank and Daniel D. Thayer

It is certified that error appears in the above-identified patent and that said Letters Patent is hereby corrected as shown below:

Column 4, line 37, --sutmation-- should read "saturation"

Signed and Sealed this

Thirty-first Day of October, 2000

*Attest:*

*Attesting Officer*

Q. TODD DICKINSON

*Director of Patents and Trademarks*